United States Patent [19]

Creedon

[11] Patent Number: 4,622,824

[45] Date of Patent: Nov. 18, 1986

[54] CRYOSTAT SUSPENSION SYSTEM

[75] Inventor: Richard L. Creedon, San Diego, Calif.

[73] Assignee: GA Technologies Inc., San Diego, Calif.

[21] Appl. No.: 772,040

[22] Filed: Sep. 3, 1985

[51] Int. Cl.[4] ..... F17C 7/02

[52] U.S. Cl. ..... 62/55; 138/112; 138/114

[58] Field of Search ..... 138/112, 114; 62/55, 62/45

[56] References Cited

U.S. PATENT DOCUMENTS

| | | | |
|---|---|---|---|
| 3,110,324 | 11/1963 | De Haan | 138/114 |
| 3,383,875 | 5/1968 | Haas | 62/55 |
| 3,469,607 | 9/1969 | Anderson | 138/114 |
| 3,777,501 | 12/1973 | Sharp et al. | 62/55 |
| 3,791,416 | 2/1974 | Ziemek et al. | 138/112 |
| 4,492,090 | 1/1985 | Laskaris | 62/55 |

*Primary Examiner*—Ronald C. Capossela

*Attorney, Agent, or Firm*—Fitch, Even, Tabin & Flannery

[57] ABSTRACT

A low heat transfer suspension system for supporting from a warmer annularly shaped outer vessel an enclosed cold annularly shaped inner vessel is disclosed. The system comprises a truss comprised of a material with low coefficient of thermal conduction attached at a plurality of positions about an outer circumference of the inner vessel at approximately the midplane of the inner vessel and attached at a plurality of positions about an inner circumference of the outer vessel such circumference being substantially in a plane which is substantially parallel to but axially offset from the midplane of the inner vessel.

20 Claims, 19 Drawing Figures

CRYOSTAT SUSPENSION SYSTEM

BACKGROUND OF THE INVENTION

The present invention relates to cryostat construction and in particular relates to a low-heat transfer stiff suspension system for supporting a cold inner vessel from a warmer surrounding outer vessel. Aspects of the present invention include the provision of a suspension system for use in the construction of nuclear magnetic resonance (NMR) imaging systems and other systems which contain superconducting coils. The suspension system must allow for substantial thermal contraction and expansion, be capable of withstanding forces experienced in operation and in transportation and minimize heat transfer into the cryostat.

Conventional cryostats for these uses commonly "hang" the cold inner vessel from the outer vessel with long thin elements of low thermal conductivity. Many of these designs require disruption of the cryostat vacuum for the purpose of inserting temporary stiffening supports to protect the magnet and internal components during transportation. Other designs attempt to avoid such disruption by providing low thermal conductive pins which the inner vessel contacts during transportation. Avoiding disruption of the cryostat vacuum is very important since the process of drawing the vacuum and the cool down of an NMR magnet assembly can take approximately one week and require the use of cryogens costing over $10,000.

SUMMARY OF THE INVENTION

The present invention is a low heat transfer suspension system for use in supporting an inner circularly cylindrical vessel from an outer circularly cylindrical vessel which encloses and is essentially concentric with the inner vessel. A truss comprised of material with a low coefficient of thermal conduction is attached at a plurality of positions about an outer circumference of the inner vessel at approximately the midplane of the inner vessel, and attached at a plurality of positions about an inner circumference of the outer vessel such circumference being substantially in a plane which is substantially parallel to but axially offset from midplane of the inner vessel.

DETAILED DESCRIPTION OF THE INVENTION

Figure 1:
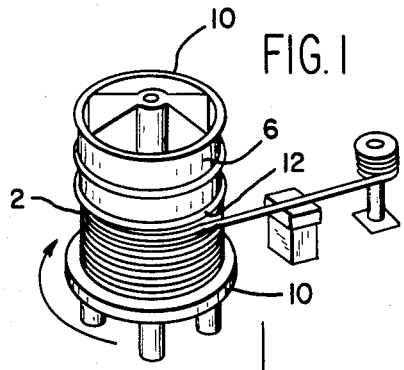
FIGS. 1 through 12 are schematic diagrams illustrating the principal steps in the assembly of a preferred embodiment of the suspension system of the present invention.
Figure 2:
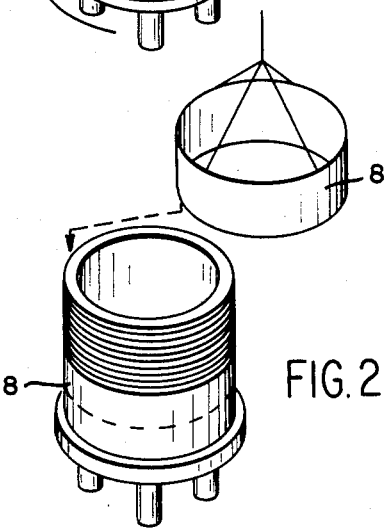
Figure 3:
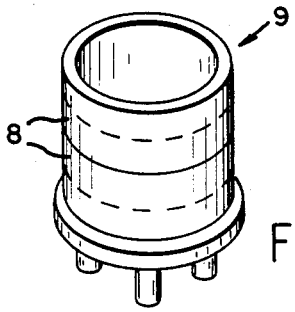
Figure 4:
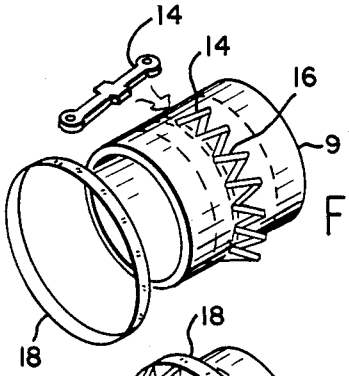
Figure 5:
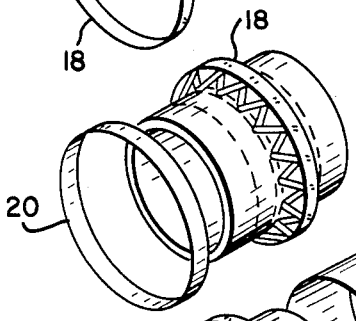
Figure 6:
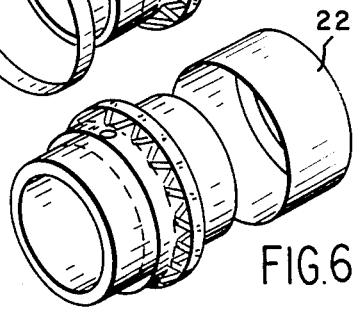
Figure 7:
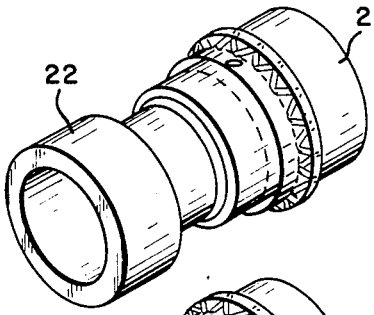
Figure 8:
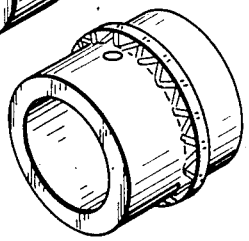
Figure 9:
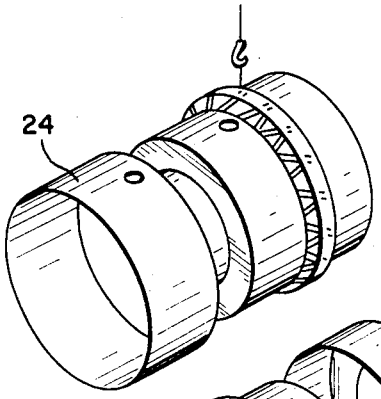
Figure 10:
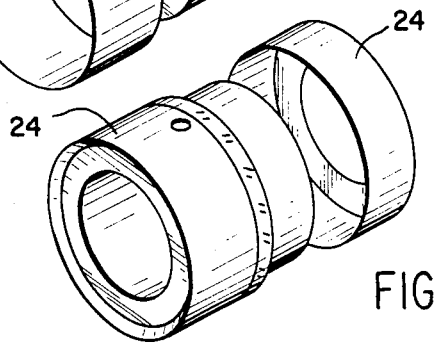
Figure 11:
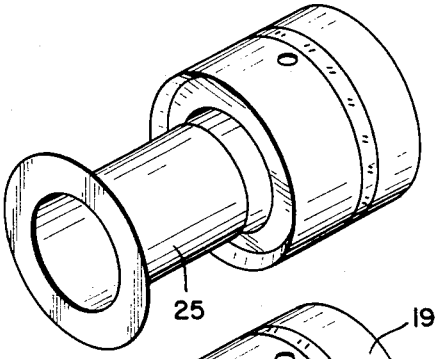
Figure 12:
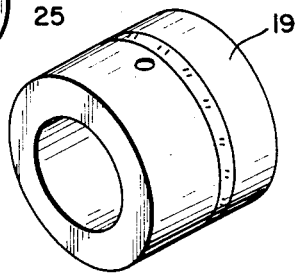

A preferred embodiment of this invention can be described by reference to FIGS. 1–12 which describe the assembly sequence of a superconducting magnet assembly making use the subject invention. As shown in FIG. 1, a coil 2 of the superconducting magnet is wound on a spool 6 having two end faces 10 and a center support 12. As shown in FIGS. 2 and 3, an inner vessel 9 is formed by welding two halves of the inner vessel outer wall 8 to the end faces 10 and the center support 12 of the spool. Support struts 14 are attached as shown in FIG. 4 to the inner vessel 8 at attachment positions 16 around the circumference of the vessel at the location of the center support. Each attachment position may comprise a single attachment point or two attachment points located close to each other. As shown in FIGS. 4 and 5, a support ring 18 to which an outer vessel 19 will be attached is added and a central ring 20 of a heat radiation shield is added. The heat radiation shield 22 is added as shown in FIGS. 6, 7 and 8 completely encircling the inner vessel. Next, the outer walls 24 of the outer vessel are added as shown in FIGS. 9 and 10 and the inner wall 28 of the outer vessel is added as shown in FIG. 11 completing the assembly of principal elements of the cryostat as shown in FIG. 12.

Figure 13:
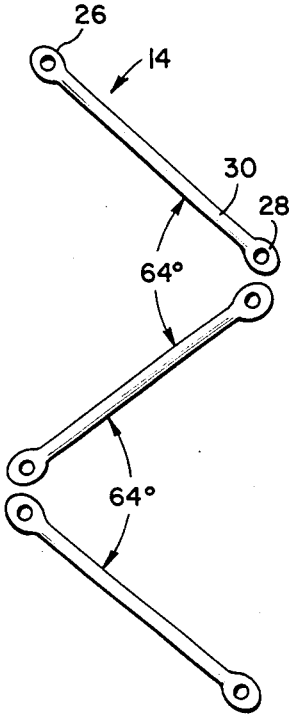
FIG. 13 is a schematic diagram of three typical support struts of a preferred embodiment showing their general shape and relative location.

Detailed description of the support struts are shown in FIG. 13. In the preferred embodiment 50 such struts in the general shape of a "dog bone" are used to support an inner annularly shaped vessel having an outside diameter of about 57 inches from the outer wall of an annularly shaped outer vessel which outer wall has a diameter of about 67 inches. Each support strut 14 contains a bolt hole 26 for attachment to the inner vessel and a bolt hole 28 for attachment to the outer vessel and a smaller bolt hole 30 for attachment of a heat shield mounting bracket. In this preferred embodiment each strut makes an angle of approximately 64 degrees with the adjacent strut. The dog bones are fabricated from $\frac{3}{4}'' \times \frac{1}{2}''$ epoxy fiberglass G10. This material is a commercial product available from Spaulding Fibre, Tonawanda, New York 14225.

Figure 15:
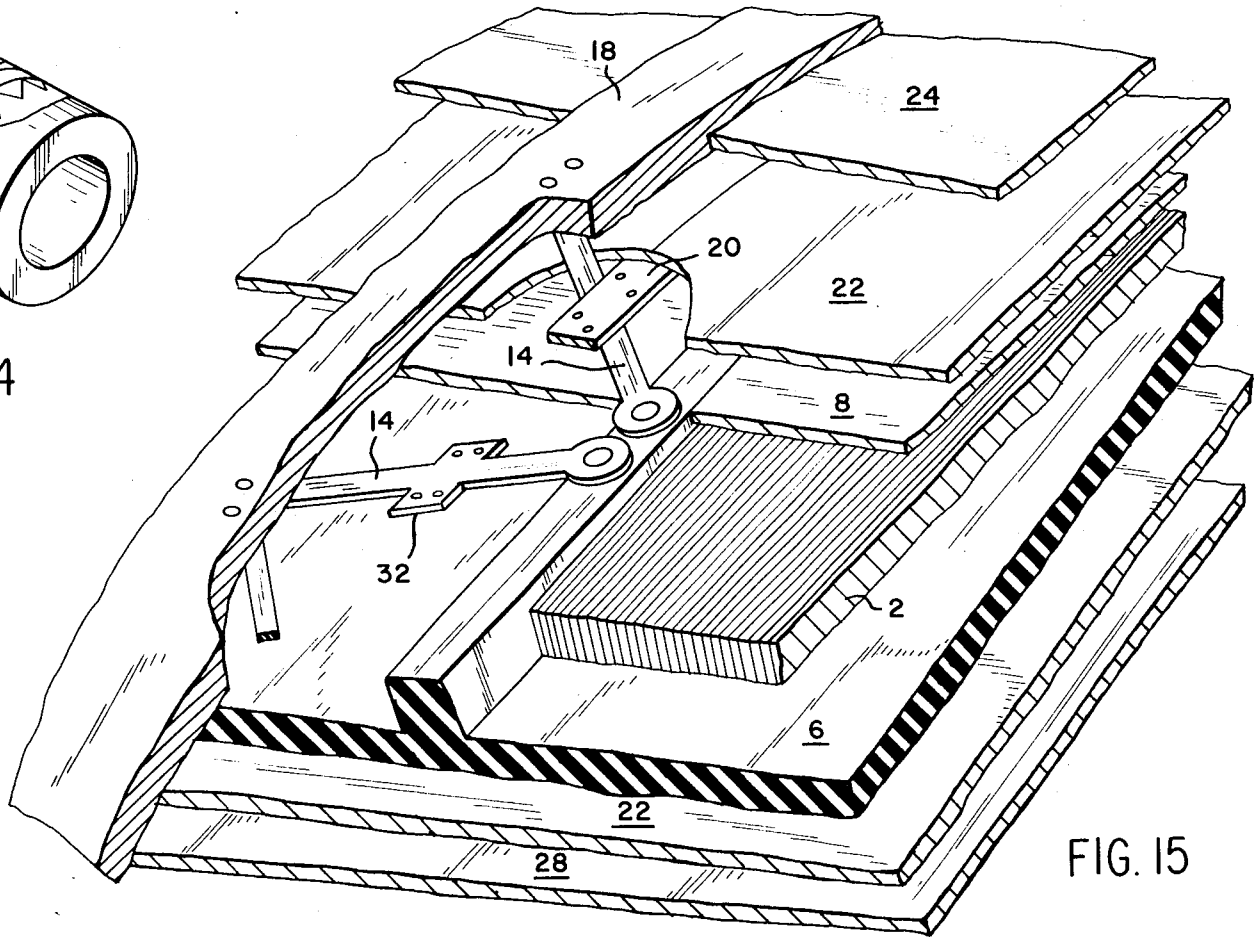
FIG. 15 is an enlarged schematic view of the cutaway portion of FIG. 14 illustrating in greater detail some of the principal features of a preferred embodiment.
Figure 14:
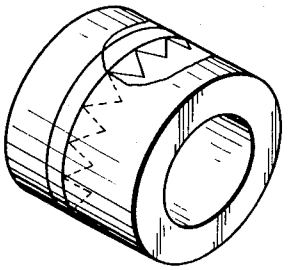
FIG. 14 is a schematic diagram of the assembled cryostat particularly illustrating the suspension system with a cutaway showing a portion of the suspension system of a preferred embodiment.

FIG. 14 shows a complete cryostat assembly with a portion cutaway permitting a viewing of the support struts, and this cutaway view is enlarged in FIG. 15. Shown in the cutaway view are the coil 2, the spool 6, which is also the inside wall of the inner vessel, the outer wall of the inner vessel 8, the central ring 20 of the heat radiation shield 22, the heat radiation shield 22, the support struts 14, a radiation heat shield mounting bracket 32, the outer vessel support ring 18 and the outer and inner walls 24 and 28 of the outer vessel.

The struts may be bolted to the vessels, or a number of other methods well known in the art may be utilized to attach the struts. The precise method of attaching the central ring of the heat radiation shield to the struts is not critical, as several methods well known in the art are available, one method being to first attach an appropriate heat shield mounting bracket to each strut, then to attach the central ring of the heat radiation shield to the brackets.

When this invention is utilized in circumstances requiring high intensity magnetic fields produced by superconductive windings, the space inside the inner vessel not occupied by the coil will be filled with a low temperature coolant such as liquid helium which is allowed to boil at atmospheric pressure. Liquid nitrogen, also boiling at atmospheric pressure, may be used to cool the radiation shield; and specially designed electrical connections are required for energizing the coil. The means for introducing these fluids and maintaining them in the proper quantity, and the means for removing vapor as well as the design of appropriate electrical connections, are well known in the art, are not essential elements of this invention, and are not shown in the drawings.

The support structure described above is equivalent to a continuous skirt of shallow conical shape, girding the waist of the cold mass. The skirt imparts great cross-sectional stiffness to the midplane of the outer vacuum vessel shell (i.e., resistance to buckling deformations). Since both the cold support cylinder and the vacuum tank are very stiff against transverse planar distortion, the outer vacuum vessel shell is constrained to react the support loads as a beam with a large moment of inertia -- i.e., as a monocoque. In the preferred embodiment, the attachment positions on the outer vacuum vessel shell are located on a circumference, the plane of which is offset from the plane of the attachment positions on the inner vessel by a distance which is slightly more than 2 times the difference between the radius of the inside surface of the outer vessel and the radius of the outside surface of the outer wall of the inner vessel. (In a second preferred embodiment described below the offset distance is about 4 times this difference in radius.) Thus, the skirt in this embodiment roughly defines an angle with the axis of the two vessels of about 25 degrees. Each strut has a compressive strength of 8,567 lb. at the cold modulus of $4\times10^6$ in second mode buckling. This is more than sufficient to handle the expected load. For transportation the cryostat is normally placed in a position such that the axis of the two vessels is in the vertical direction. For the preferred embodiment, the 2g axial plus 40,000 lb. load is only 2,594 lb. per strut and the 6g travel load is only 4,932 lbs. per strut. Loads of 2g for operation and 6g for transportation are typical design requirements for NMR magnets. The heat leak through the support structure at a coil temperature of 4.2k is only approximately 1 W.

Figure 16A:
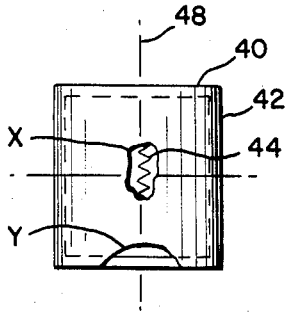
FIG. 16A and 16B are the side and front view of a cryostat with cutaway views in FIG. 16A illustrating an embodiment of the present invention.
Figure 16B:
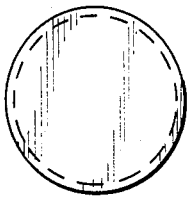
Figure 17:
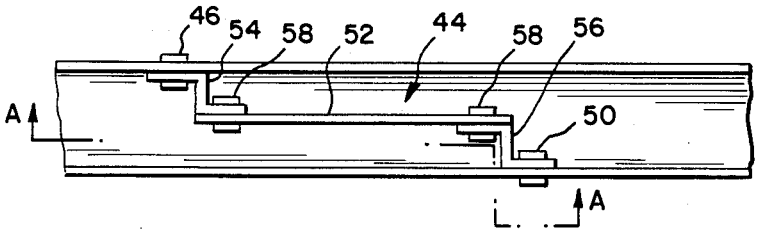
FIGS. 17 and 18 are enlarged cutaway views of a portion of the preferred embodiment shown in FIGS. 16A and 16B.
Figure 18:
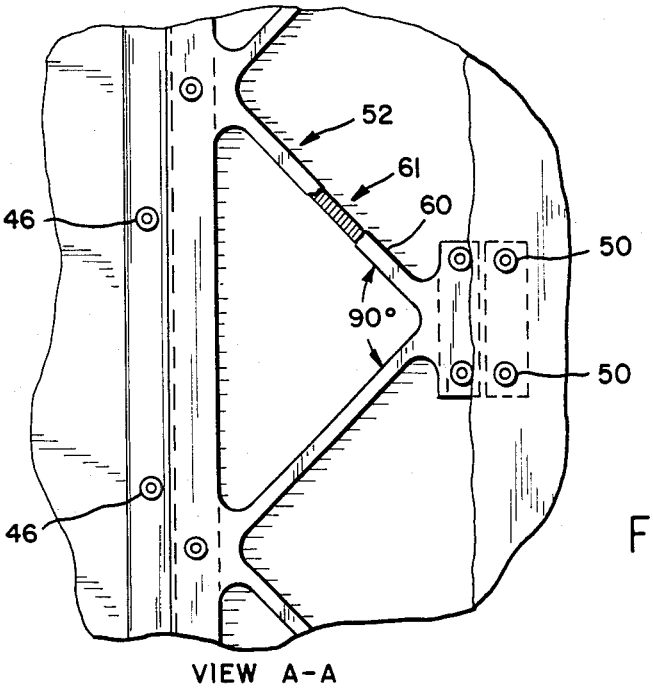

Another preferred embodiment is described by reference to FIGS. 16A and B, 17 and 18. In this embodiment inner vessel 40 is supported from outer vessel 42 by truss assembly 44 which is shown through cutaway views X and Y in FIG. 16A and in detail in FIGS. 17 and 18. Truss assembly 44 is attached by rivets 46 to the inner vessel along the outside circumference of the inner vessel which defines a plane 48 containing the center of mass of the inner vessel and by rivets 50 to the outer vessel along an inside circumference which lies in a plane parallel to but axially offset from plane 48. The truss assembly 44 is comprised of truss band 52 with struts 60, an aluminum support ring 54 and aluminum support tabs 56. Truss band 52 is cut from a G10 epoxy fiberglass piece 3/16"×4-¼" and long enough to encircle the 60-inch diameter inner vessel with about 12" overlap. Truss band 52 is attached to ring 54 and tabs 56 with rivets 58. Slightly longer rivets 58 are used to join the two ends of truss band at the 12-inch overlap portion (not shown). The individual struts 60 of truss band 52 form an angle of 90° with each other and are cut so that either the warp or the woof of the G10 fiberglass is parallel to the center line of each strut as shown at 61 in FIG. 18. This second, preferred embodiment may be used to support an inner thermal shield from an outer thermal shield in an NMR magnet assembly where the inner shield weighs up to approximately 350 pounds. If used to support a heavier vessel, the parts of the truss assembly would have to be appropriately designed for the heavier load.

From the above, it can be seen that the present invention is particularly useful in the construction of cryostats. In particular, it is seen that the present invention is particularly suitable for transport of the cryostat in which full vacuum and coolant conditions are maintained. It is also seen that the present invention is also particularly useful in those applications in which it is desired to construct electromagnets employing superconducting windings. Such windings are disposed about the central core of the cryostat so as to be particularly useful in generating high intensity, relatively uniform magnetic fields along the longitudinal axis of the cryostat bore. In this fashion, the present invention provides a useful device for NMR imaging systems. It is also seen that a cryostat using the present invention eliminates both elastomer seals and nonmetallic bore tubes which are permeable to gasses and can result in long-term contamination of interior vacuum conditions. Accordingly, costly periodic pumping of cryostat vacuum is not required. The present invention avoids conditions which result in shutting down and warming up of the magnet. In addition, the present invention provides a means to greatly facilitate the assembly of a cryostat.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

I claim:

1. A low heat transfer suspension system for use in supporting from an outer circularly cylindrical vessel an inner circularly cylindrical vessel enclosed by and essentially concentric with said outer vessel comprising a truss having two ends which is attached at an end to a plurality of positions about an outer circumference of the inner vessel at approximately the center of mass of the inner vessel, said outer circumference defining a midplane of said inner vessel, and which is attached at the other end at a plurality of positions about an inner circumference of the outer vessel such inner circumference being substantially in a plane which is substantially parallel to but axially offset from said midplane of said inner vessel such truss being comprised of a material of low thermal conductivity.

2. The suspension system of claim 1 wherein said truss comprises a number of struts.

3. The suspension system of claim 2 wherein a plurality of said struts lie in planes which form angles of between 30° and 60° with the central axis of the inner vessel.

4. The suspension system of claim 3 wherein essentially each of said struts is essentially the same length and disposed essentially uniformly and end-to-end about the inner vessel.

5. The suspension system of claim 2 wherein a plurality of said struts lie on a cylindrical surface which is between and approximately concentric with the cylindrical surfaces of the two vessels.

6. The suspension system of claim 1 in which the truss comprises a plurality of struts cut at right angles in a single piece of woven fiberglass so that the center line of each strut is parallel to either the warp or woof of the fiberglass.

7. The suspension system of claim 6 in which a radiation shield is attached to the struts and suspended between the inner vessel and the outer vessel.

8. The suspension system of claim 6 in which the struts are rigidly attached to both of the vessels.

9. The suspension system of claim 6 wherein said woven fiber glass is G10 fiber glass.

10. The suspension system of claim 1 wherein said axial offset is large relative to the difference between the radius of said inner circumference and the radius of said outer circumference.

11. A cryostat comprising:

a substantially rigid outer, evacuable vessel having an annular shape;

a substantially rigid inner vessel having an annular shape and being wholly contained within said outer vessel so that the central axis of said inner vessel and said outer vessel lie substantially along the same line;

a truss having two ends which is attached at one end at a plurality of positions about an outer circumference of the inner vessel at approximately the center of mass of the inner vessel said outer circumference defining a midplane of said inner vessel and which is attached at the other end at a plurality of positions about an inner circumference of the outer vessel such inner circumference being substantially in a plane which is substantially parallel to but axially offset from said midplane of said inner vessel such truss being comprised of a low heat transfer material.

12. The suspension system of claim 11 wherein said truss comprises a number of struts comprised of a low heat transfer material.

13. The suspension system of claim 12 wherein substantially all of said struts are substantially the same length and disposed substantially uniformly and end-to-end about the inner vessel.

14. The cryostat of claim 12 wherein said low heat transfer material is G10 fiber glass.

15. The cryostat of claim 11 in which the struts comprise fiber matrix.

16. The cryostat of claim 11 in which a radiation shield is attached to the struts and suspended between the inner vessel and the outer vessel.

17. The cryostat of claim 11 in which the struts are rigidly attached to both of the vessels.

18. The cryostat of claim 11 in which the struts are disposed substantially uniformly about both vessels, all struts are substantially the same length, and the plane of attachment on the outer vessel is offset from the plane of attachment on the inner vessel by a distance which is between 2 and 4 times the difference between the radius of the inside surface of the outer vessel and the radius of the outside surface of the inner vessel.

19. The cryostat of claim 11 in which the truss comprises a plurality of struts cut at right angles in a single piece of fiberglass so that the center line of each strut is parallel to either the warp or woof of the fiberglass.

20. The suspension system of claim 11 wherein said axial offset is large relative to the difference between the radius of said inner circumference and the radius of said outer circumference.

* * * * *